United States Patent [19]

Grivet

[11] 4,204,672

[45] May 27, 1980

[54] DEVICE FOR CONVEYING SHEETS WITHIN A SHEET PROCESSING MACHINE

[75] Inventor: Francis Grivet, Morges, Switzerland

[73] Assignee: J. Bobst & Fils, S.A., Lausanne, Switzerland

[21] Appl. No.: 909,035

[22] Filed: May 24, 1978

[30] Foreign Application Priority Data

May 26, 1977 [CH] Switzerland ..... 006477/77

[51] Int. Cl.[2] ..... B65H 29/70

[52] U.S. Cl. ..... 271/188; 271/195

[58] Field of Search ..... 271/188, 195

[56] References Cited

U.S. PATENT DOCUMENTS

| | | | |
|---|---|---|---|
| 2,697,506 | 12/1954 | Snyder | 271/188 X |
| 2,944,813 | 7/1960 | Smith | 271/188 X |
| 3,104,101 | 9/1963 | Rabinow | 271/188 X |
| 3,139,278 | 6/1964 | Maidment | 271/188 |
| 3,606,312 | 9/1971 | Mens | 271/188 X |

*Primary Examiner*—Richard A. Schacher

*Attorney, Agent, or Firm*—Hill, Van Santen, Steadman, Chiara & Simpson

[57] ABSTRACT

A device for transferring a sheet from one station to a second station in a sheet processing device with the device including at least one lower conveyor and at least one upper conveyor arranged to discharge a sheet from a first station onto a third conveyor at the second station characterized by means disposed adjacent the lower conveyor to bend the sheet traveling between the upper and lower conveyor transverse to the direction of movement of the sheet, means for guiding the sheet as it is being discharged from the upper and lower conveyors onto the third conveyor and means for ensuring the depositing of the sheet onto the third conveyor as it is discharged from the upper and lower conveyor.

5 Claims, 5 Drawing Figures

DEVICE FOR CONVEYING SHEETS WITHIN A SHEET PROCESSING MACHINE

BACKGROUND OF THE INVENTION

1. Field of the Invention

The present invention is directed to a device for ensuring sheet conveyance within a sheet processing machine.

2. Prior Art

Sheet processing machines are composed of several stations and definite operations are achieved or accomplished on the sheet at each of the stations. A problem, which always occurs in such devices, is the ensuring of a proper conveyance between two successive stations. In certain cases, the sheet is conveyed from one station to another by means of belt conveyors bridging over the gap between the two stations. However, when a sheet is transferred from one station in which the sheets are being fed one after the other to a second station where the sheets should be placed one upon the other in such a way to be shingled like tiles of a roof, it is necessary to use a conveying device consisting of upper and lower conveyors at the first station. In such a case, the upper conveyor should be slightly longer than lower coveyors so as to be able to ensure the ejection of the sheet, which may be a box blank, from between the upper and lower conveyor. As a rule, the first station in which the sheets are being conveyed one after the other, utilizes an upper and lower continuous belt conveyor arranged side by side whereas the station in which the sheets are to be shingled consist of a lower continuous belt conveyor on which several pressure rollers act to ensure the foward motion of the stream of shingled sheets supported thereon. The lower belt at the second station is driven at a slower speed than the upper and lower conveyors of the preceeding station so that the shingling of the blanks or sheets will occur.

To ensure a reliable transfer of a sheet or blank from one station to the second station and to ensure that the sheet is pushed under the driving appliance of the second station by the conveyors of the preceeding first station, the above described conveyor devices require that the blanks or sheets have an adequate stiffness. When the sheets being handled by the device easily bend and do not have the required stiffness, the bending of the sheets will impair the formation of the stream of shingled blanks or sheets and may, at the worst, create jam-ups at the transfer between the two stations which jam ups cause a stopping of the sheet processing machines. It is also noted that the majority of the sheets being processed in such a transfer station do not have the required stiffness.

SUMMARY OF THE INVENTION

The present invention is directed to a device for ensuring the transfer of a sheet from a first station to a second station regardless of the weight or stiffness of the sheet. To accomplish this task, the present invention is directed to an improvement in a device for transferring a sheet from a first station to a second station which device includes a first station with at least one lower conveyor and at least one upper conveyor arranged to discharge the sheet onto a third conveyor at the second station. The improvements comprise means disposed adjacent a lower conveyor for bending a sheet traveling between the upper and lower conveyors transverse to the direction of movement of the sheet, means for guiding the sheet as it is being discharged from the upper and lower conveyors, and means for ensuring the depositing of the sheet onto the third conveyor as it is discharged from said upper and lower conveyors.

The means for bending comprises a pair of plate members, which are bent to have two portions extending at an angle to each other and preferably have a leading edge which extends at an angle to the junction between the first and second portions so that the plate is mounted on the frame of the conveyor with one portion extending across a conveyor plane so the sheet being transported along said lower conveyor engages said edge of the plate and is bent upward and transverse to the direction of conveyance.

The means for guiding the sheet leaving the upper and lower conveyor comprises a dog or rod which is adjustably engaged within a tube. The tube is mounted on a strap, which is pivotably mounted on an axle of one of the pulleys of the upper conveyors so that the dog will engage the sheet as it is being discharged onto the third conveyor and is able to move in an arc around the point of attachment. The means for ensuring the depositing of each of the sheets onto the third conveyor preferably comprises a blower having at least two nozzles, said nozzles being adjustably mounted on a support adjacent the end of the upper conveyor so that a sheet extending passed the end of the upper conveyor is subjected to air blown through the nozzles.

DESCRIPTION OF THE PREFERRED EMBODIMENTS

The principles of the present invention are particularly useful in a device generally indicated at 60 (FIG. 1) for transferring a sheet such as 32 from a first station generally indicated at 11 to a second station generally indicated at 28.

Figure 2:
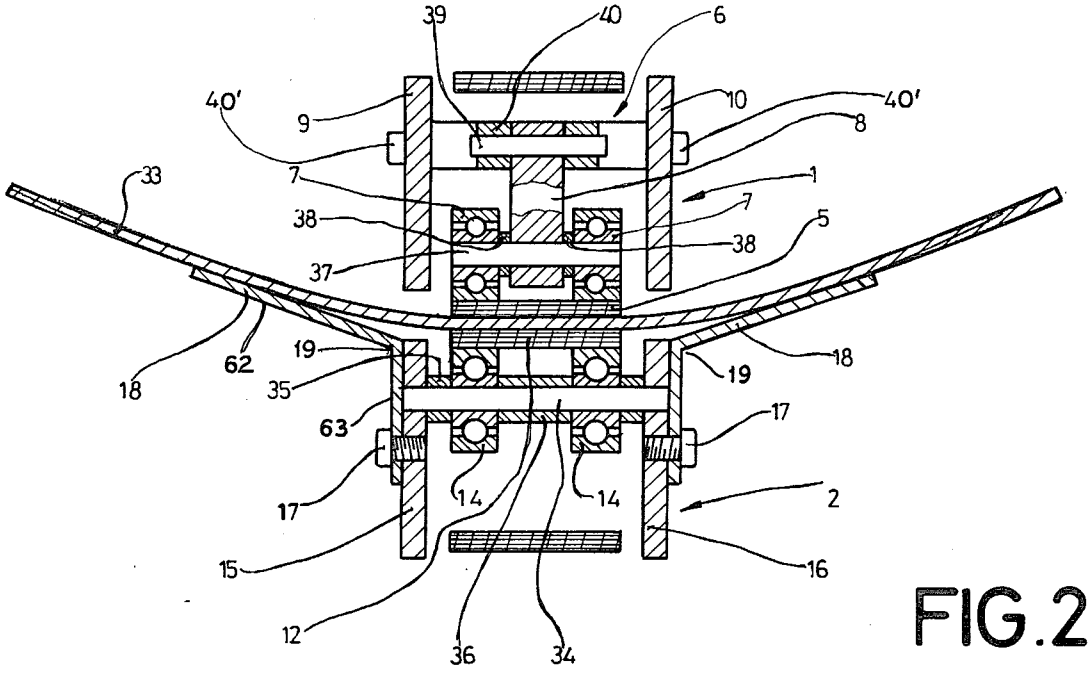
FIG. 2 is a cross-sectional view taken along line II—II of FIG. 1.

The first station 11 has an upper conveyor 1, which acts jointly with a lower conveyor generally indicated at 2. The upper conveyor 1 consists of two pulleys 3 and 4 on which an endless or continuous belt 5 is disposed. A pressure track generally indicated at 6 applies pressure to a portion of the belt by utilizing a plurality of rollers 7, which are supported on ends of spring loaded levers 8 to ensure that a driving friction is applied on the belt 5 of the upper conveyor 1. Each of the pulleys 3 and 4 is secured or mounted in such a way as to be capable of rotating freely on their axles 20 and 20' and the conveyor 1 is mounted between a pair of side guides or plates 9 and 10, which are best illustrated in FIG. 2 and are mounted on a suspension device (not illustrated) of a frame of the station 11 of the device 60.

The lower conveyor 2 consists of an endless belt 12 supported on a pulley 13 and driven by a drive pulley (not illustrated). The lower conveyor 2 is equally disposed between two side guides 15 and 16 which are best illustrated in FIG. 2. In addition to the end pulley 13 and the drive pulley (not illustrated), a plurality of rollers 14, which are mounted between the side guides 15 and 16 are provided to support the lower belt 12.

Figure 1:
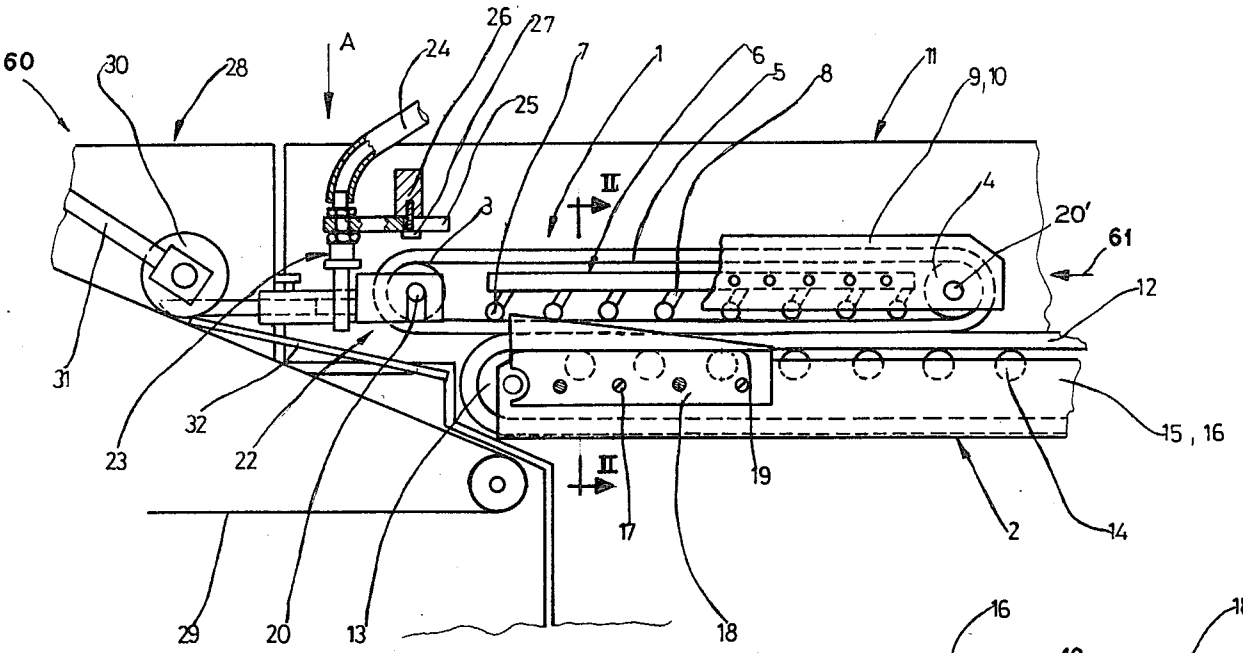
FIG. 1 is a partial side view with portions broken away for purposes of illustration of a device for transferring a sheet between two stations in accordance with the present invention.
Figure 5:
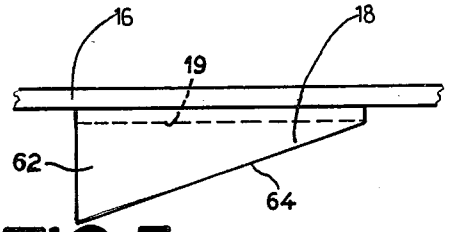
FIG. 5 is a plan view of the bending device of the present invention.

To provide means for bending a blank which is being transported in a direction of arrow 61 by the upper and lower conveyors 1 and 2, a bending plate 18 is secured by screws 17 on each side of the lower frame members 15 and 16 adjacent the pulley 13. As illustrated in FIGS. 1, 2 and 5, each of the bending plates 18 is bent or folded along a line 19 to form a first portion 62 and a second portion 63 which extend in different planes from the bend or junction line 19. Each of the plates 18 is mounted on a side member by the screws 17 with the first portion 62 extending in a plane, which is at an angle with a plane of conveyance defined by the surfaces of the belts 5 and 12 and the portion 62 extends across the plane of conveyance. It should be noted that each of the plates 18 has the first portion 62 (FIG. 5) cut along a line 64 which extends at an angle to the line 19 and provides a leading edge. Thus, when a blank or sheet such as 33 (FIG. 2) is moved in the direction of arrow 61 (FIG. 1), the leading edge of the sheet engages the leading edge 64 and causes the sheet 33 to bend into the trough-shape which is transverse to the direction of conveyance as illustrated in FIG. 2.

Figure 3:
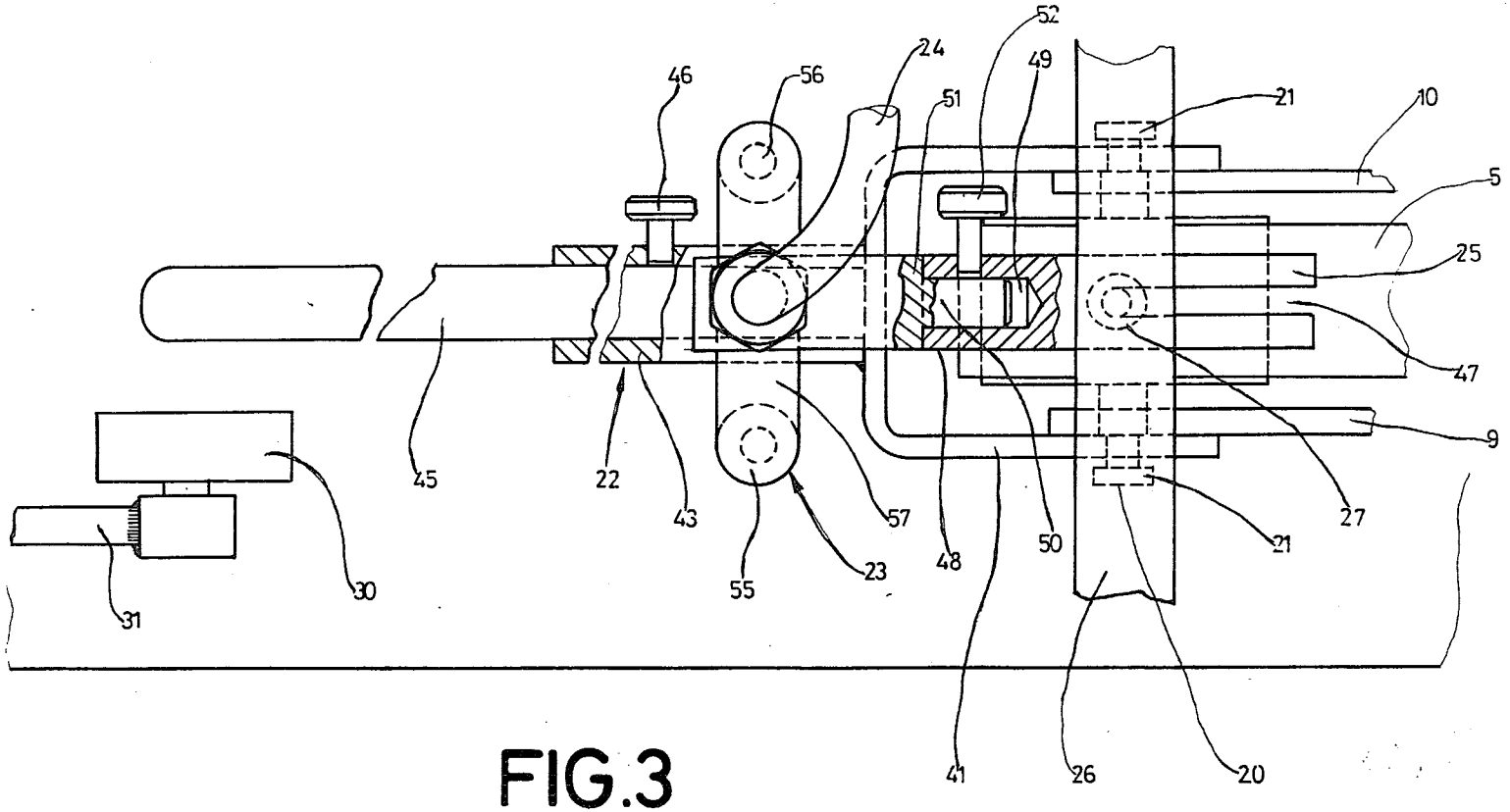
FIG. 3 is a partial plan view taken in the direction of arrow A in FIG. 1 of a portion of the transfer device of the present invention.

The axle 20 for the roller 3 of the upper conveyor 1 is provided with extensions best illustrated at 21 as illustrated in FIG. 3. The extensions 21 provide a pivotal mounting for a guide generally indicated at 22. In addition to the guide 22, a blower means 23 for ensuring the depositing of a blank such as 32 on a third conveyor 29 of the station 28 is provided. The blower means 23 receives air from a source (not illustrated) by conduit 24 and is supported on a member or support 25 which is adjustably mounted on a cross bar 28 of the frame of the device 60 by a threaded fastener such as a screw 27.

The second station 28 includes a lower belt 29 on which several rollers such as 30 are arranged to engage a blank such as 32 being conveyed therealong. Each of the rollers 30 is secured on a pivotably mounted arm 31. As best illustrated in FIG. 2, a sheet such as 33 which is being transported by the belts 5 and 12 of the conveyors 1 and 2 is engaged by the portion 62 of the bending plates 18 and curved in a transverse direction to the direction of conveyance 61 (FIG. 1) into a trough shape. This bending which results in a trough-shape of the blank 33 produces considerably increase in the lengthwise stiffness of the sheet being processed and enables inserting the sheet by the conveyors 1 and 2 in the next station 28.

Each of the rollers 14 (FIG. 2) is fitted or received on an axle or shaft 34, which extend between the side guides 15 and 16 and have had their ends staked thereto. To ensure proper axial spacing of the rollers 14 which are illustrated as including ball bearings, spacing bushings 35 and 36 are utilized. The rollers 7 of the upper conveyor 1 are mounted on the spring loaded arms 8 by being mounted on axles 37 carried by the spring loaded arms and spaced from the arms by spacing bushings such as 38. To ensure that the rollers 7, which also include ball bearings remain on the axles 37, the ends of the axles are upset or punched to hold the rollers thereon. The spring loaded arms 8 pivot around axles such as 39 which are received on bars 40 of the pressing track 6. The bars 40 of the pressing tack 6 are held between the two side guides 9 and 10 by appropriate fastening means such as screws 40'.

Figure 4:
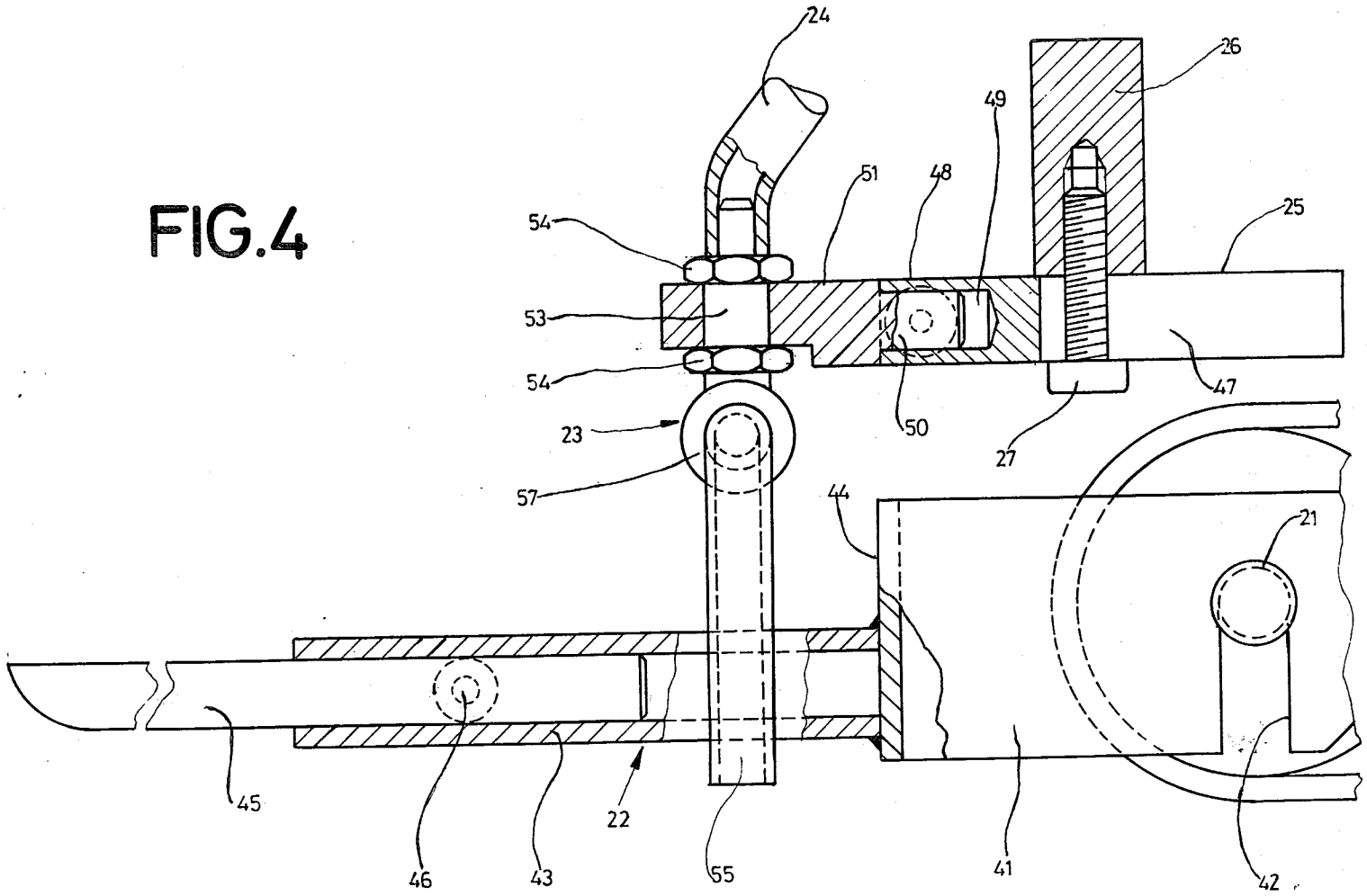
FIG. 4 is a cross-sectional view with portions in elevation for purposes of illustration of the guide portion and nozzles illustrated in FIG. 3.

The guide 22 as best illustrated in FIGS. 3 and 4 includes a U-shaped stirrup 41 which is provided on each of the legs with a slot-shaped aperture 42 for receiving the extension 21 of the axle 20. The bight portion 44, which extends between the legs 41, supports or carries a square tube 43, which is secured thereon by welding. The square tube 43 receives a dog 45, whose axial position therein may be secured by means of a pressure or set screw 46. Thus the guide 22 can pivot on the axle 20 so that a round end of the dog 45 (FIG. 4) will always rest on the belt 29 beside one of the rollers such as 30. Due to the pivotal movement of the guide 22 on the extensions 21 of the axle 20, the dog 45 is able to yield as a blank such as 32 passes between the dog and the belt.

The blower means 23, as mentioned hereinabove, has an adjustable support 25, which is best illustrated in FIGS. 3 and 4 and includes a slot 47 that extends around a portion of the screw 27. The member 25 has one end 48 with a cylindrical bore 49 for receiving a cylindrical stub or section 50 of a fastening flange or member 51. The flange or member 51 can be held in its position by the action of a pressure or set screw 52. The flange or member 51 has a bore, which receives a connection 53, which is held in place by nuts 54. The connection 53 is connected to the blower nozzles 55 and 56 by means of a collector or manifold 57 and interconnects the two nozzles 55 and 56 with the supply conduit 24. Due to the adjustable mounting means formed by the member such as 25 and the screw 27, the position of the nozzles 55 and 56 can be adjusted to provide a maximum blowing power on the sheet as it is being discharged from between the first and second conveyors of the first station 11.

With the above-mentioned improvements of a transfer device, an operator of the device is provided with means for ensuring the depositing of a blank from the conveyors of the first station onto the conveyor of the second station, means for guiding the blank as it is being deposited, and bending means, which enable the proper transfer of light weight and very flexible blanks or sheets. Thus, the device of the present invention provides means for processing light weight and thin sheets as well as ensuring the reliability of the sheet processing machine.

Although various minor modifications may be suggested by those versed in the art, it should be understood that I wish to embody within the scope of the patent granted hereon, all such modifications as reasonably and properly come within the scope of my contribution to the art.

I claim:

1. In a device for transferring a sheet from one station to a second station, said device including a first station with at least one lower conveyor and at least one upper conveyor arranged to discharge the sheet onto a third conveyor at the second station the improvements comprising means disposed adjacent the lower conveyor for bending a sheet traveling between the upper and lower conveyors transverse to the direction of movement of the sheet, means for guiding the sheet as it is being discharged from the upper and lower conveyors, said means for guiding comprising a dog adjustably engaged within a tube, said tube being mounted on a strap, said strap being pivotably mounted on the axis of one of the pulleys of the upper conveyor so that the dog engages the sheet as it is being discharged onto the third conveyor, and means for ensuring the depositing of the sheet onto the third conveyor as it is discharged from said upper and lower conveyors.

2. In a device according to claim 1, wherein said means for bending the sheet comprises a pair of plates, said plates being mounted on the lower conveyor with surfaces of the plates extending at an angle to a conveyor plane of the conveyor and the surfaces of said plates intersecting said conveyor plane so that a sheet being transported along said lower conveyor engages an edge of said plates and is bent upward and transverse to the direction of conveyance.

3. In a device according to claim 2, wherein each of the plates has a bent portion extending in a plane at an angle to the first mentioned portion, said first mentioned portion being cut at an angle to the line of junction between the first and second portion to form said edge, each of said plates being mounted on a frame of the lower conveyor by said second portions being attached to a frame member thereof.

4. In a device according to claim 2, wherein the means for ensuring depositing of each of the sheets onto the third conveyor as they are discharged from the upper conveyor comprises a blower having at least two nozzles, said nozzles being adjustably mounted on a support adjacent to the end of said upper conveyor so that a sheet extending passed the end of said upper conveyor is subjected to air blown through said nozzles.

5. In a device according to claim 1, wherein the means for ensuring depositing of each of the sheets onto the third conveyor as they are discharged from the upper conveyor comprises a blower having at least two nozzles, said nozzles being adjustably mounted on a support adjacent to the end of said upper conveyor so that a sheet extending passed the end of said upper conveyor is subjected to air blown through said nozzles.

* * * * *